US006257228B1

(12) United States Patent
Braccini

(10) Patent No.: US 6,257,228 B1
(45) Date of Patent: Jul. 10, 2001

(54) TEMPERED GLASS HOB FOR KITCHEN

(75) Inventor: Danilo Braccini, Ponte a Moriano (IT)

(73) Assignee: Curvet SPA (IT)

( * ) Notice: Subject to any disclaimer, the term of this patent is extended or adjusted under 35 U.S.C. 154(b) by 0 days.

(21) Appl. No.: 09/551,363

(22) Filed: Apr. 18, 2000

(51) Int. Cl.[7] ..... F24C 15/10

(52) U.S. Cl. ..... 126/211; 126/214 R; 126/39 B; 219/452.11

(58) Field of Search ..... 126/211, 217, 126/218, 219, 214 R, 215, 216, 214 C, 214 A, 212, 220, 39 R, 40, 39 B; 219/443.1, 451.1, 452.11, 452.12

(56) References Cited

U.S. PATENT DOCUMENTS

| | | | | |
|---|---|---|---|---|
| 3,663,244 | * | 5/1972 | Martin | 501/23 |
| 5,088,470 | * | 2/1992 | James, Jr. et al. | 126/41 R |
| 5,549,100 | * | 8/1996 | Heisner et al. | 126/214 R |
| 5,755,215 | * | 5/1998 | Mickens et al. | 126/547 |
| 5,866,239 | * | 2/1999 | Shimatani et al. | 428/210 |
| 5,931,152 | * | 8/1999 | Fafet et al. | 126/214 R |
| 6,087,637 | * | 7/2000 | Fischer et al. | 219/452.11 |

FOREIGN PATENT DOCUMENTS

| | | | |
|---|---|---|---|
| 0 464 323 | * | 1/1992 | (EP) . |
| 0 615 096 | * | 9/1994 | (EP) . |
| 2 626 965-A1 | * | 10/1987 | (FR) . |
| 2 079 119 | * | 1/1982 | (GB) . |

* cited by examiner

*Primary Examiner*—Ira S. Lazarus
*Assistant Examiner*—Josiah C. Cocks
(74) *Attorney, Agent, or Firm*—Sheridan Ross P.C.

(57) ABSTRACT

A hob (1) consisting of a sheet (2) of tempered glass for kitchen appliances, wherein said sheet of glass (2) has holes (3, 4) with shaped edges, such as to create raised parts or protrusions (5) which rise above the surface of said sheet of glass (2).

Preparation of the hob (1) comprises heating of said sheet (2) to the softening temperature of glass, after creation of the holes (3, 4),. In this manner said raised parts (5) arc formed and the microcracks that are generated during creation of the holes in the sheet of glass are also eliminated.

9 Claims, 2 Drawing Sheets

TEMPERED GLASS HOB FOR KITCHEN

DESCRIPTION

The present invention concerns a new tempered glass hob for kitchen, as well as the method used for making thereof.

The cooker hob is the main element in that part of kitchen electrical appliances devoted to cooking. In particular, it represents the heating element of cycles for saucepans, frying pans etc. The hob can be electric, that is heated by electrical resistors, can work with gas burners, or can be combined, electric and gas. Moreover, the hob can be of stainless steel, enamelled steel, vitreous ceramic or smooth float glass.

The aim of using glass hobs (in general) instead of the more traditional steel ones derives from a decision by the electrical appliance manufacturers and is based essentially on reasons of an aesthetic nature, because the innovative, fashionable look, better design opportunities and the possibility of applying the most varied and unlimited shades of colour compared with the colors that can be applied with enamelling. Another advantage of the glass cooker hob is that it does not require considerable investments in equipment (molds) as is the case for steel, on the other hand, and therefore favours a wide diversification of models at limited cost.

Currently known to the art are hobs made of transparent glass, consisting of a perfectly flat sheet of glass wherein the openings that serve to contain both the heating elements (electric plates, gas burners and the like) and the knobs and other controls in general are made by mechanical drilling.

The structure with a smooth, flat surface of the hobs of the prior art has the drawback of allowing foreign matter (generally liquid and solid food residues) to pass through these openings. Consequently, the underlying frame that supports the hob tends to get dirty and, with it, the supports of the electric plates and the gas burners, as well as any controls, also get dirty.

Added to this is the fact that the food residues that fall through the holes or the plates present on the hob often have a doughy consistency and are difficult to remove from the above mentioned parts, also because of the obstacles that are encountered when access to the inside area of the hob is desired.

Another drawback encountered in hobs of the prior art is that of the microcracks caused by the mechanical processes at the holes for containing the burners. These microcracks, which are unavoidable in normal glass drilling processes, can in fact give rise to breakage of the sheet of glass that forms the hob, as a result of the thermal shock induced by the high temperatures that are generated in proximity to the burners.

The main object of the present invention is that of providing a new hob for kitchens in general, such as to avoid foreign matter falling through the holes containing the heating means. The invention further has the object of providing a method for making said hob, such as to impart thereto a greater resistance to the thermal shock at the drilled surfaces that are situated near the burners.

These and other objects are achieved with the hob and with the method of claims 1 and 3.

Further characteristics of said hob and of said method will emerge from the remaining claims.

With respect to cooking hobs of the prior art consisting of a drilled sheet of glass, the hob according to the invention offers the advantage of creating an obstacle to solid and liquid food residues falling through the holes containing the burners.

A further advantage lies in the fact that thanks to the method of the invention, microcracks at said holes are substantially eliminated with the result of giving the hob a better resistance to thermal shock.

These and other objects, characteristics and advantages emerge from the description that follows, made with reference to the figures of the attached drawings which illustrate, by way of non-limiting example, a hob according to the present invention. In these drawings.

Figure 1:
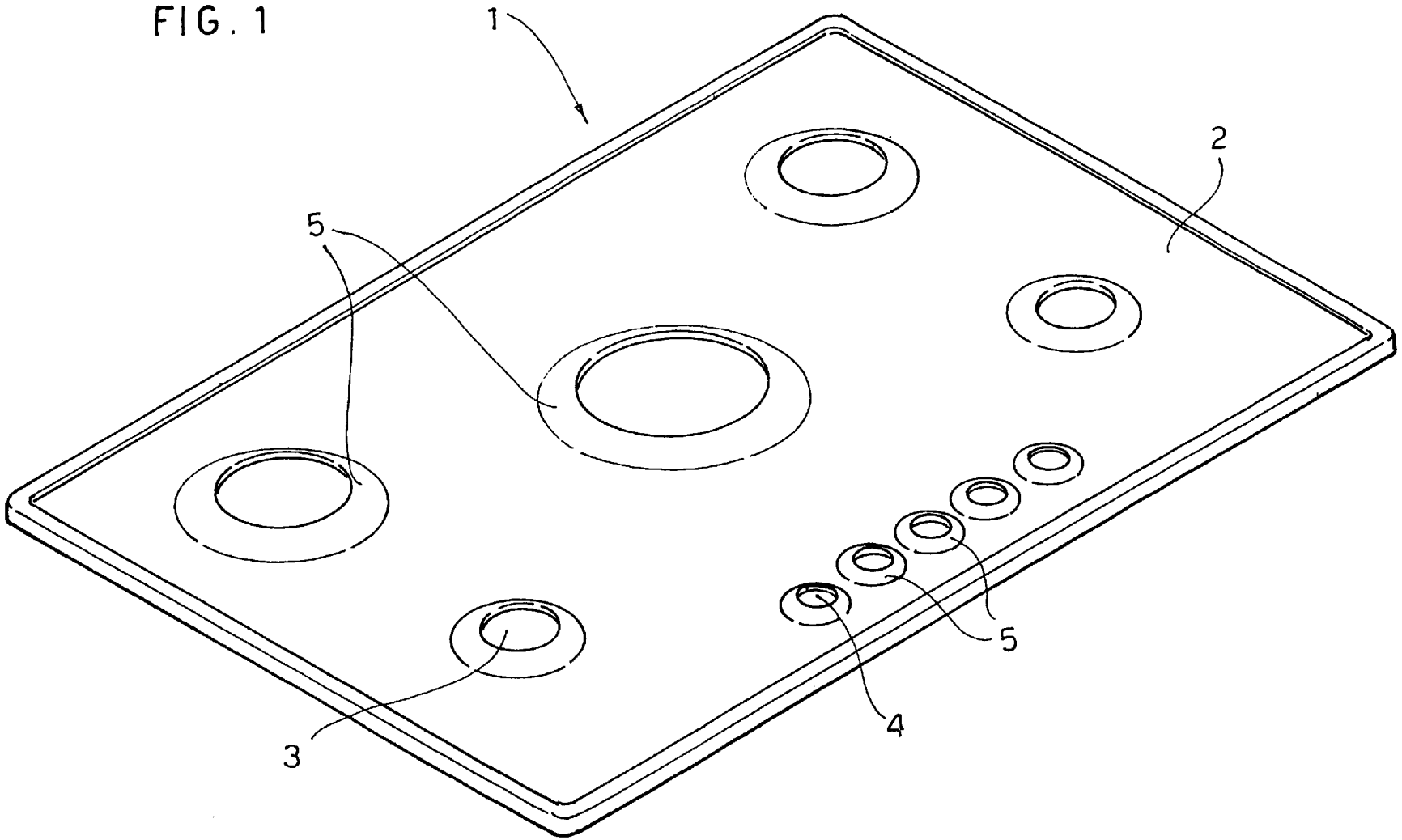
FIG. 1 is a perspective view of the hob according to the invention.
Figure 2:
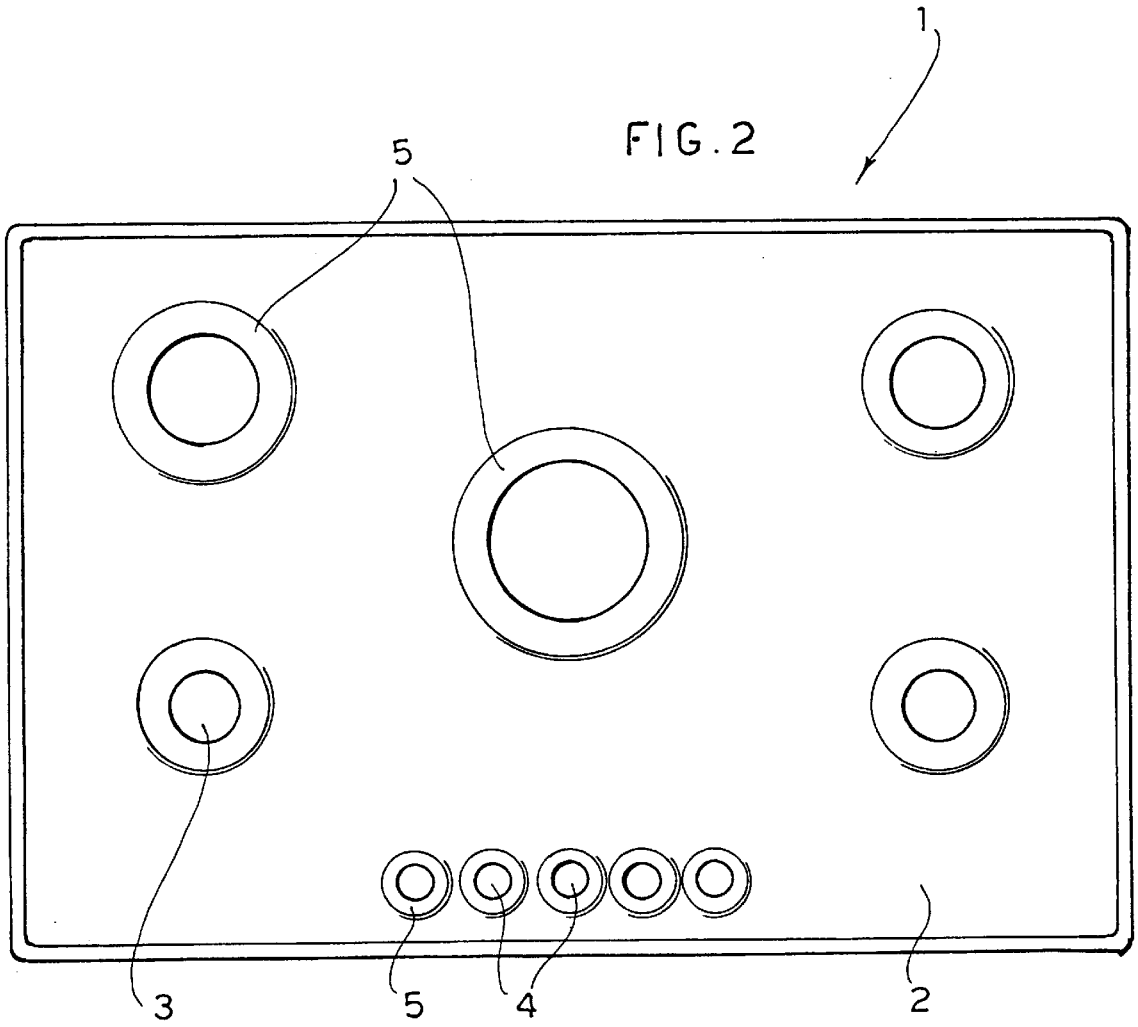
FIG. 2 is a plan view of the hob of FIG. 1.
Figure 3:
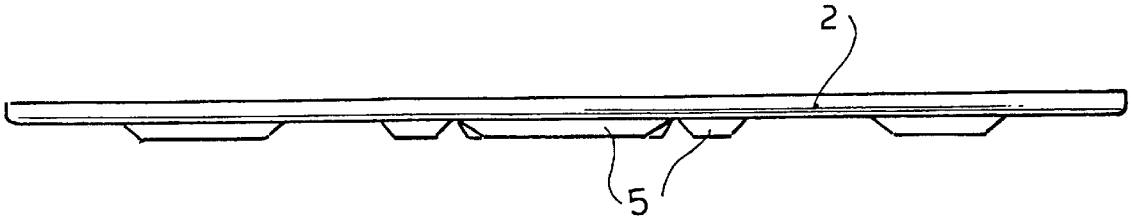
FIG. 3 shows the hob of FIG. 2 in a rear side view.

The hob of the invention is denoted as a whole with 1 in FIG. 1. It consists essentially of a sheet of tempered glass 2, wherein holes or openings 3 are present for housing of the heating elements (gas burners and electric plates) as well as the holes or openings 4 for containing the controls of the cooker (not illustrated) destined to receive the hob 1.

According to the invention, the edges of the holes 3 and 4 are shaped so as to create a raised part or protrusion 5 that rises above the surface of the plate 2 of the hob 1. Thanks to the presence of these raised parts, the liquid and solid residues that fall onto the hob are stopped at the holes 3 and 4, which prevents them from falling or dripping onto the part beneath.

During mechanical processing of the hob, used to create the holes 3 and 4 on the plate 2, microcracks are inevitably generated at the edges of said holes. These microcracks can favor breakage of the sheet of glass 2, as a result of the thermal shock induced by the high temperatures that are generated in proximity to the burner.

With the object of avoiding this drawback, the sheet of glass 2 is heated before the tempering treatment, to the temperature of softening of glass. This heating, besides allowing creation (for example by molding) of the raised parts 5 at holes 3 and 4, also performs the important function of eliminating the aforementioned microcracks and, therefore, of giving the hob better resistance to the thermal shock produced by the burners.

According to a preferred embodiment of the method of the invention, the holes 3 and 4 for the heating means, for the control knobs, etc. are first created in the sheet of glass. Subsequently, the sheet 2 is heated to softening (about 800° C.), which makes it possible to eliminate the microcracks on the edges of the aforementioned holes. Said edges are then shaped (by dropping into a die or by molding at the aforementioned softening temperature), so as to create raised parts 5 coinciding therewith which rise above the sheet 2.

Preferably, moreover, in order to make the surface of the hob 1 easier to clean and proof against the organic acids normally present in foods, after drilling of the plate 2 and before heating thereof, provision is made for addition of an enamel.

After these operations, the hob is finally tempered.

What is claimed is:

1. A tempered glass hob for cooking appliances in general, characterized in that it comprises:

a sheet of tempered glass;

a plurality of holes in said sheet for electric burners and gas burners, wherein said holes have shaped edges rising above the surface of said sheet; and a plurality of holes in said sheet for stove controls, wherein said holes have shaped edges rising above the surface of said sheet.

2. A tempered glass hob as in claim 1, wherein the shaped edges are convex.

3. A tempered glass hob as in claim 1, wherein the shaped edges do not have microcracks.

4. A method for making the hob according to claim 1, characterized in that it comprises:

first, drilling of the sheet of glass so as to form therein a plurality of holes or openings;

second, heating of said sheet to softening temperature of glass and until the microcracks generated at the edges of said holes by said drilling process are eliminated;

third, shaping of the edges of said holes to obtain raised parts or protrusions that rise above surface of the sheet; and fourth, tempering of the sheet of glass thus obtained.

5. A method according to claim 4, characterized in that said shaping of the edges of the holes is achieved through gravity or by dropping onto a die, with the sheet heated to the softening temperature of glass.

6. A method according to claim 4, characterized in that said shaping is achieved by molding of said sheet heated to the softening temperature of glass.

7. A method according to claim 4, characterized in that it further comprises addition of an enamel to said sheet of glass, after drilling and before heating.

8. A method according to claim 5, characterized in that it further comprises addition of an enamel to said sheet of glass, after drilling and before heating.

9. A method according to claim 6, characterized in that it further comprises addition of an enamel to said sheet of glass, after drilling and before heating.

* * * * *